United States Patent [19]

Wüllenweber et al.

[11] Patent Number: 4,961,901

[45] Date of Patent: Oct. 9, 1990

[54] PROCESS AND APPARATUS FOR MANUFACTURING DIAPHRAGMS

[75] Inventors: Heinz Wüllenweber, Frankfurt am Main; Peter Kohl, Neuberg; Herbert Jung, Oberursel, all of Fed. Rep. of Germany; Jorgen Borchardt, Troistorrents, Switzerland; Wolfgang Bickle, Reilingen, Fed. Rep. of Germany; Jürgen Braus, Walldorf, Fed. Rep. of Germany; Hans-Joachim Hiedemann, Cologne, Fed. Rep. of Germany

[73] Assignee: Metallgesellschaft AG, Frankfurt, Fed. Rep. of Germany

[21] Appl. No.: 339,747

[22] Filed: Apr. 18, 1989

[30] Foreign Application Priority Data

Apr. 23, 1988 [DE] Fed. Rep. of Germany ..... 3813743

[51] Int. Cl.[5] ..... B22F 5/00

[52] U.S. Cl. ..... 419/2; 419/3; 419/8; 419/19; 419/43; 419/57; 419/69; 419/45

[58] Field of Search ..... 419/2, 3, 19, 43, 69, 419/8, 57, 45

[56] References Cited

U.S. PATENT DOCUMENTS

| | | | |
|---|---|---|---|
| 3,403,999 | 10/1968 | Bliss | 419/43 |
| 4,172,111 | 10/1979 | Donnelly | 264/111 |
| 4,394,244 | 7/1983 | Divisek et al. | 204/295 |
| 4,670,214 | 6/1987 | Magnuson et al. | 419/3 |

FOREIGN PATENT DOCUMENTS 0022252 4/1983 European Pat. Off. .

*Primary Examiner*—Stephen J. Lechert, Jr.
*Assistant Examiner*—Leon Nigohosian, Jr.
*Attorney, Agent, or Firm*—Sprung Horn Kramer & Woods

[57] ABSTRACT

In a process of manufacturing diaphragms, a layer of a difficulty flowable metal powder is applied to a support, a wire net is rolled onto the powder layer and the latter is compacted at the same time and the metal powder is fired at 800° to 1500° C. in an oxidizing atmosphere. In order to impart to the diaphragms a constant thickness, strength and density, the metal powder is uniformly distributed and applied as regards its bulk volume to the support and the powder layer is moved under a distributing roller rotating opposite to the direction in which the powder is fed.

8 Claims, 1 Drawing Sheet

PROCESS AND APPARATUS FOR MANUFACTURING DIAPHRAGMS

BACKGROUND OF THE INVENTION

This invention relates to a process of manufacturing diaphragms having a thickness of 0.3 to 3.0 mm and consisting of a wire net, preferably a nickel wire net, which serves as a carrier, and a porous ceramic layer having a thickness of 0.1 to 2.8 mm, which is joined to said wire net, preferably for electrolyses, wherein a layer consisting of metal powder which is flowable with difficulty, preferably a nickel powder, which consists of irregularly shaped particles, is applied to a support, the wire net is rolled or pressed onto the powder layer and the latter is compacted by 30 to 60% at the same time, and the metal powder is fired in an oxidizing atmosphere at temperatures of 800° to 1500° C. for 1 to 30 minutes, preferably 5 to 15 minutes.

Diaphragms for use in electrolyses should resist elevated temperatures and corrosion. They should not have an electron conductivity of their own and should have an adequate mechanical strength and their thickness should be minimized so that they have a very low resistance to the transport of electric charges in the electrolyte.

In order to accomplish this, EP-B No. 0 022 252 discloses a diaphragm which has a thickness of 0.3 to 0.7 mm and consists of porous sintered nickel, iron of copper and comprises a skeleton structure which is constituted by a wire net, preferably a nickel wire net, wherein the metal is oxidized at least in part to form metal oxide. To produce such a diaphragm a layer of the metal powder is applied to a wire net having a mesh opening size of 100 to 500 μm in that a paste consisting of the metal powder and a binder or alcohol is spread on or sprayed onto the wire net and is compacted under a pressure of about 200 kg/cm$^2$ and is simultaneously bonded to the wire net. The metal powder is subsequently subjected to a reducing sintering tretment at a temperature of 700° to 1000° C. for 10 to 20 minutes and to a succeeding oxidizing treatment at a temperature of 1000° to 1200°0 C. for up to 3 hours. Said processes can allegedly be carried out to produce diaphragms which have a large surface area and have a strength which is due to the fact that the oxidation is not excessive but a residual metallic structure is obtained. Because the formation of oxide proceeds from the surface throughout the entire body, the electrical resistance is sufficiently high. But it has been found that the diaphragms which have been described hereinbefore, particularly when they have large dimensions, do not have a constant strength, density and thickness throughout the entire body although a constant strength is required for ensuring that the surfaces of the diaphragms will resist an erosion by gas and liquid streams occurring in the cells for an electrolysis of aqueous solutions. A constant density and a constant thickness of the diaphragms are required for ensuring a uniform current density and an optimum purity of gas becasue a non-uniform current density, i.e., local concentrations of current, may result in local overheating and corrosive attacks, i.e., in a formation of holes in the diaphragms so that oxyhydrogen gas may be formed in the electrolysis of alkaline aqueous solutions.

It has been attempted to manufacture thin diaphragms having a constant, strength, density and thickness in that nickel powder is strewed onto a support through a fine-mesh screen which extends over said support at a small distance therefrom, the strewed-on nickel powder layer is compacted by rolling and the nickel wire net is joined to the nickel powder layer at the same time. But said measures will not ensure a uniform distribution of the nickel powder on the support so that the strength, density and thickness of the resulting diaphragm will not be uniform. Besides, when diaphragms having a large surface area are to be made the screen must be held at a uniform thickness from the support by means of spacers because without a provision of spacers the screen will be deflected by the nickel powder applied to the screen and under the pressure of the doctor blade which is moved over the nickel powder and the distance between the screen and the support will then be non-uniform. Moreover, spacers will form discontinuities in the nickel powder layer and the resulting gaps will strongly adversely affect the separation of the gas and the uniformity of the current flow.

SUMMARY OF THE INVENTION

It is an object of the present invention so to improve the process of the kind described first hereinbefore that thin diaphragms having a constant thickness, strength and density and a large surface area can be manufactured by a continuous process.

That object is accomplished in accordance with the invention in that the metal powder is uniformly distributed and applied to the support as regards the bulk volume of the powder and the powder layer is moved under a distributing roller rotating opposite to the direction in which the powder is fed so that a layer of uniform thickness is formed. That measure is required to ensure that the porous ceramic layers which are joined to the wire net will have a uniform thickness and will firmly be bonded to the wire net.

The metal powder is suitably applied to the support at a rate of 25 to 500 mg/cm$^2$.

The metal powder layer which has been moved under the distributing roller suitably has a thickness of 1.0 to 7.0 mm, preferably 3.0 to 5.0 mm.

The object may also be accomplished in that the metal powder is uniformly distributed and applied as regards its bulk volume to the wire net lying on a support and the powder layer is moved under a distributing roller rotating opposite to the direction in which the powder is fed so that a layer of uniform thickness is formed.

In that case it will be necessary for a coating of the wire net on both sides that the wire net with the powder layer adhering thereto is turned around to lie at the top and a layer consisting of the same metal powder is uniformly distributed and applied as regards its bulk volume and is then moved under a distributing roller rotating opposite to the direction in which the powder is fed, followed by a compaction by rolling.

To provide the wire net with a porous ceramic layer on both sides, a layer of the same metal powder is uniformly distributed and applied as regards its bulk volume to the wire net which has been rolled or pressed onto the first-mentioned powder layer and is moved under a distributing roller rotating opposite to the direction in which the powder is fed, whereby a layer of uniform thickness is formed, and is finally compacted by rolling.

The apparatus for carrying out the process, consists of a star wheel feeder which distributes and applies the pulverulent metal, a distributing roller and a compacting roll, which succeed the star wheel feeder, which compacting roll forces the wire net, which is preferably wound up on a drum, against the metal powder layer so that the openings of the wire net are filled with metal powder.

In a preferred embodiment the star wheel feeder, distributing roller and compacting roll and optionally the drum which cooperates with the compacting roll are combined in a unit which is movable along the support.

To permit a coating of the wire net on both sides within the shortest possible time another star wheel feeder and a distributing roller are associated with the unit consisting of the star wheel feeder, distributing roller and compacting roll. During the forward movement of the unit, the wire net is forced by the compacting roll into the surface of the sintered metal powder layer, which has a constant thickness, and the powder layer is compacted at the same time. During the return movement the metal powder layer which has been applied to the wire net and has a uniform thickness is compacted by the compacting roll. As a result, the irregularly spaced particles of the metal powder are so strongly joined that the resulting composite material can easily be handled. The metal powder particles interlock so strongly that diaphragms which are small in size can be made from said particles without a wire net that serves as a carrier.

The positions of the star wheel feeder and of the outlet opening of the supply bin are so selected that no metal powder can be dispensed when the star wheel feeder is at a standstill. As a result, the rate at which the metal powder is dispensed and the thickness of the layer which is distributed over and applied to the support will depend on the speed of the star wheel feeder. The thickness of the layer of metal powder on the support can also be controlled by the velocity at which the unit consisting of the star wheel feeder, distributing roller and compacting roll is moved.

The composite material can be manufactured in the form of plates or strip and is so flexible that it can be wound up on a drum without difficulty.

The invention is illustrated by way of example on the drawings and will be explained more in detail hereinafter.

DETAILED DESCRIPTION OF THE INVENTION

Figure 1:
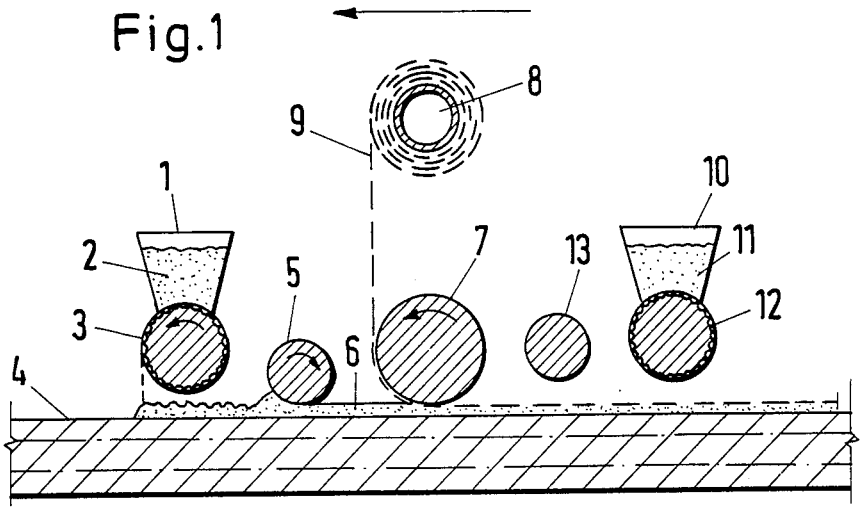
FIGS. 1 and 2 are schematic representations of the apparatus for carrying out the process according to the present invention.
Figure 2:
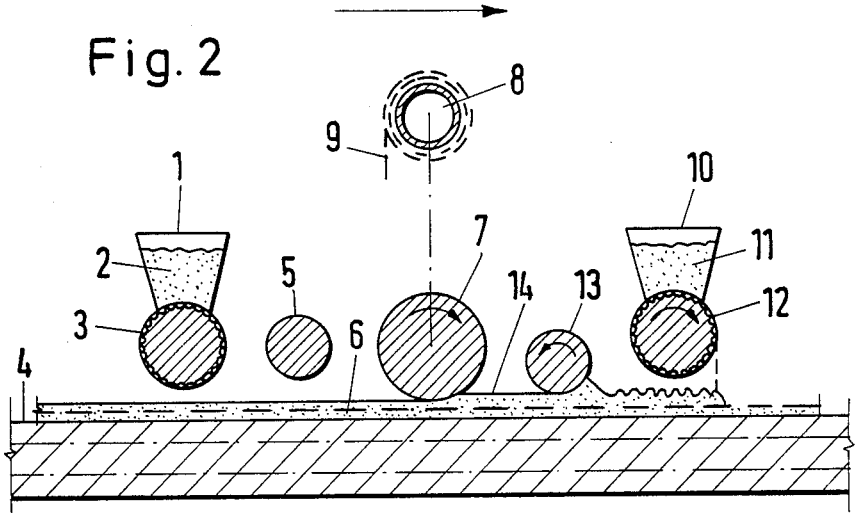

In accordance with FIGS. 1 and 2, carbonyl nickel powder 2 having a particle size of 2.2 to 2.8 μm is distributed and applied from the hopper-shaped supply bin 1 in batches on the stationary support 4 at a rate of 50 mg/cm$^2$ by means of the star wheel feeder 3, which closes the outlet opening of the supply bin 1 and comprises coaxially extending trough-shaped cells in a star-like configuration. By the distributing roller 5, which rotates opposite to the direction in which the powder is fed, the carbonyl nickel powder layer 6 is brought to a uniform thickness. The carbonyl nickel powder layer 6 is compacted to a thickness of 0.3 mm by the compacting roll 7, by which the nickel wire net 9, which is wound on the drum 8 and has a wire thickness of 0.125 mm and a mesh opening size of 0.2 mm is rolled onto the carbonge powder layer at the same time as said net is unwound from the drum 8.

When the nickel wire net 9 has been cut off, carbonyl nickel powder 10 from the supply bin 11 is applied by means of the star wheel feeder 12 to the nickel wire net 9 at a rate of 50 mg/cm$^2$. The powder layer is brought to a uniform thickness by the distributing roller 14, which rotates opposite to the direction in which the powder is fed, and the powder layer is subsequently compacted to a thickness of 0.45 mm by the compacting roll 7.

When the composite material has subsequently been fired in an oxidizing atmosphere at a temperature of 1000° for 15 minutes, the composite material has a constant thickness and constant density throughout its surface area so that an optimum wear resistance, a uniform current distribution and a high purity of the gas will be ensured. The composite material may be profiled before it is fired.

What is claimed is:

1. In a process for the manufacture of a diaphragm having a thickness of from 0.3 to 3.0 mm and comprising a carrier and a porous ceramic layer having a thickness of from 0.1 to 2.8 mm joined to the carrier, the improvement wherein the carrier is formed by applying a powder layer to a support by feeding a metal powder in a first feed direction onto the support, wherein the powder is flowable with difficulty and consists of irregularly shaped particles, moving the applied powder layer under a distributing roller rotating in a direction opposite to the first feed direction to impart a uniform thickness to the powder layer, rolling or pressing a wire net onto the uniform thickness powder layer and compacting the uniform thickness powder layer by 30 to 60% at the same time and firing the compacted powder layer and net in an oxidizing atmosphere of from 800° to 1500° C. for 1 to 30 minutes.

2. The process according to claim 1, further comprising applying and uniformly distributing a second layer of the same metal powder by feeding the metal powder onto the wire net in a second feed direction, moving the second metal powder layer under a distributing roller rotating in a direction opposite the second feed direction to impart a uniform thickness to the second metal powder layer and compacting the uniform thickness second metal powder layer by rolling.

3. The process according to claim 1, wherein the metal powder is applied in a dry form.

4. The process according to claim 2, wherein the first and second feed directions are opposite to each other.

5. In a process for the manufacture of a diaphragm having a thickness of from 0.3 to 3.0 mm and comprising a carrier and a porous ceramic layer having a thickness of from 0.1 to 2.8 mm joined to the carrier, the improvement wherein the carrier is formed by applying a wire net onto a support, applying a powder layer onto the wire net on the support by feeding a metal powder in a first feed direction onto the wire net, wherein the powder is flowable with difficulty and consists of irregularly shaped particles, moving the applied powder layer under a distributing roller rotating in a direction opposite to the first feed direction to impart a uniform thickness to the powder layer, joining the uniform thickness metal powder layer to the wire net by rolling or pressing the uniform thickness metal powder layer while compacting the uniform thickness powder layer by 30 to 60% at the same time and firing the compacted powder layer and net in an oxidizing atomosphere of from 800° to 1500° C. for 1 to 30 minutes.

6. The process according to claim 5, further comprising turning over the wire net and powder layer and applying and uniformly distributing a second layer of the same metal powder by feeding the metal powder onto the turned over wire net in a second feed direction, moving the second metal powder layer under a distributing roller rotating in a direction opposite the second feed direction to impart a uniform thickness to the second metal powder layer and compacting the uniform thickness second metal powder layer by rolling.

7. The process according to claim 5, wherein the metal powder is applied in a dry form.

8. The process according to claim 6, wherein the first and second feed directions are opposite to each other.

* * * * *